US009972879B2

(12) United States Patent
Zhang et al.

(10) Patent No.: US 9,972,879 B2
(45) Date of Patent: May 15, 2018

(54) MICROWAVE FILTER

(71) Applicant: Johnson Electric S.A., Murten (CH)

(72) Inventors: Yong Gang Zhang, Shenzhen (CN); Hong Wei Zhang, Shenzhen (CN); Jian Zhao, Shenzhen (CN)

(73) Assignee: JOHNSON ELECTRIC S.A., Murten (CH)

( * ) Notice: Subject to any disclaimer, the term of this patent is extended or adjusted under 35 U.S.C. 154(b) by 111 days.

(21) Appl. No.: 14/830,354

(22) Filed: Aug. 19, 2015

(65) Prior Publication Data

US 2016/0056520 A1 Feb. 25, 2016

(30) Foreign Application Priority Data

Aug. 19, 2014 (CN) ..... 2014 1 0413316

(51) Int. Cl.
*H01P 3/08* (2006.01)
*H01P 1/203* (2006.01)

(52) U.S. Cl.
CPC ..... *H01P 1/203* (2013.01); *H01P 1/20363* (2013.01); *H01P 1/20381* (2013.01)

(58) Field of Classification Search
CPC .. H01P 1/203; H01P 1/20363; H01P 1/20381; H01P 1/2039; H01P 7/084
USPC ..... 333/204, 205, 238, 246
See application file for complete search history.

(56) References Cited

U.S. PATENT DOCUMENTS 5,719,539 A * 2/1998 Ishizaki ..... H01P 1/20345 333/204
5,977,847 A * 11/1999 Takahashi ..... H01P 1/2039 333/204
6,078,117 A 6/2000 Perrin et al.
8,081,051 B2 * 12/2011 Huang ..... H01P 1/2039 333/12
2011/0050355 A1 * 3/2011 Huang ..... H01P 1/2039 333/12
2012/0081193 A1 * 4/2012 Shirakawa ..... H03H 7/06 333/176

* cited by examiner

*Primary Examiner* — Robert J Pascal
*Assistant Examiner* — Kimberly Glenn
(74) *Attorney, Agent, or Firm* — Muncy, Geissler, Olds & Lowe, P.C.

(57) ABSTRACT

A microwave filter includes a strip transmission line and a filtering assembly connected to the strip transmission line. The transmission line has an input terminal and an output terminal. The filtering assembly includes a strip first primary branch connected directly to a first connection point of the transmission line. The first primary branch includes a first body portion and a first bent portion at a first end of the first body portion, where the first bent portion is connected directly to the first connection point, and the first body portion is substantially parallel to a body portion of the transmission line. With the microwave filter incorporated in an electric motor, the impedance curve of the transmission line can be matched with a high-frequency EMI curve, and therefore the filtering effect is enhanced, EMI is suppressed and the EMC level improved.

17 Claims, 6 Drawing Sheets

MICROWAVE FILTER

CROSS REFERENCE TO RELATED APPLICATIONS

This non-provisional patent application claims priority under 35 U.S.C. § 119(a) from Patent Application No. 201410413316.3 filed in The People's Republic of China on Aug. 19, 2014, the entire contents of which are hereby incorporated by reference.

FIELD OF THE INVENTION

This invention relates to the technical field of microwave filtering and in particular, to an electric motor having a microwave filter.

BACKGROUND OF THE INVENTION

An idealized LC filtering circuit is shown in FIG. 1, and a schematic diagram of an equivalent circuit of the LC filtering circuit in the practical application (particularly in the microwave domain) is shown in FIG. 2. In the practical application, an inductor L is equivalent to an idealized inductor LCM connected in parallel with a parasitic resistor (an equivalent parallel resistor EPR) and a parasitic capacitor (an equivalent parallel capacitor EPC), and a capacitor C is equivalent to an idealized capacitor Cy connected in serial with a parasitic inductor (an equivalent series inductor ESL/2) and a parasitic resistor (an equivalent series resistor EPR/2).

Further, as shown in FIG. 3, a conductor has similar characteristics to the above description in a high-frequency domain. In FIG. 3, an actual wire is shown on the left side, and two equivalent models of the wire in the high-frequency domain are shown on the right side.

A parasitic inductance and a parasitic capacitance of the conductor such as the inductor and the capacitor may influence the insertion loss and EMI (electromagnetic interference) of the circuit. FIG. 4 shows a graph of a simulation result of the circuit shown in FIG. 1. Referring to FIG. 4, a curve 1 represents the insertion loss of a filter constructed with ideal elements, a curve 2 represents the insertion loss in the case where only the series parasitic inductance is taken into account, a curve 3 represents the insertion loss in the case where the parallel parasitic resistance and the series parasitic resistance are taken into account, a curve 4 represents the insertion loss in the case where the parallel parasitic capacitance is taken into account, and a curve 5 represents the insertion loss in the case where the above four parasitic parameters are taken into account.

SUMMARY OF THE INVENTION

Since the electromagnetic interference (EMI) is significantly influenced, there is a need for a microwave filter in which the filtering effect is improved by adjusting an impedance curve of a transmission line.

Accordingly, in one aspect thereof, the present invention provides a microwave filter, comprising: a strip transmission line having an input terminal and an output terminal, and a filtering assembly connected to the transmission line, wherein the filtering assembly comprises a strip first primary branch connected directly to a first connection point of the transmission line and a strip first secondary branch connected directly to the first primary branch, and wherein a width of the first secondary branch is different from a width of the first primary branch.

Preferably, the first primary branch extends in a direction perpendicular to the transmission line.

Preferably, the filtering assembly further comprises a strip second primary branch connected directly to a second connection point of the transmission line, and a second secondary branch connected directly to the second primary branch, wherein a width of the second secondary branch is different from a width of the second primary branch.

Preferably, a width of the second primary branch is different from a width of the first primary branch.

Preferably, the first primary branch and the second primary branch are arranged at two opposite sides of the transmission line respectively.

Preferably, the transmission line is bent in a direction of the first primary branch on both sides of the first connection point to form a first "⊏"-shaped portion; and the transmission line is bent in a direction of the second primary branch on both sides of the second connection point to form a second "⊏"-shaped portion, wherein an opening of the first "⊏"-shaped portion is oriented in an opposite direction to an opening of the second "⊏"-shaped portion.

Preferably, the transmission line further comprises a third "⊏"-shaped portion for connecting the first "⊏"-shaped portion to the second "⊏"-shaped portion in series.

According to a second aspect, the present invention provides a microwave filter, comprising: a strip transmission line having an input terminal and an output terminal, and a filtering assembly connected to the transmission line, wherein the filtering assembly comprises a strip first primary branch connected directly to a first connection point of the transmission line, wherein the first primary branch comprises a first body portion and a first bent portion at a first end of the first body portion, wherein the first bent portion is connected directly to the first connection point, and the first body portion is substantially parallel to a body portion of the transmission line.

Preferably, the filtering assembly further comprises a strip second primary branch connected directly to a second connection point of the transmission line, the second primary branch comprises a second body portion and a second bent portion at a first end of the second body portion, wherein the second bent portion is connected directly to the second connection point, and the second body portion is substantially parallel to the body portion of the transmission line.

Preferably, the body portion of the transmission line is arranged between the first body portion and the second body portion.

Preferably, the body portion of the transmission line is arc-shaped.

Preferably, a width of the body portion of the transmission line, a width of the first body portion and a width of the second body portion are different.

Preferably, the filtering assembly further comprises a first secondary branch, the first secondary branch comprises a third body portion and a third bent portion at a first end of the third body portion, wherein the third bent portion is connected directly to a second end of the first body portion, and the third body portion is substantially parallel to the first body portion.

Preferably, a pad is formed between a terminal and the first connection point of the transmission line.

Preferably, a width of the transmission line and a width of the first primary branch are in a range between 0.15 mm and 1.1 mm.

According to a third aspect, the present invention provides an electric motor, comprising a power supply circuit for the motor, wherein at least one microwave filter as defined above, is connected in series in the power supply circuit.

Preferably, there are two microwave filters arranged in a same plane in the motor.

Preferably, there are two microwave filters arranged in a ring shape in the motor.

By implementing the invention, the impedance curve of the transmission line can be matched with a high-frequency EMI curve, and therefore the filtering effect is enhanced, EMI may be suppressed and the EMC level improved.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
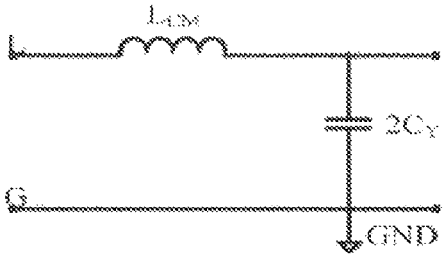
Figure 1 (Prior Art)
FIG. 1 is a schematic diagram of an ideal LC filtering circuit.
Figure 2:
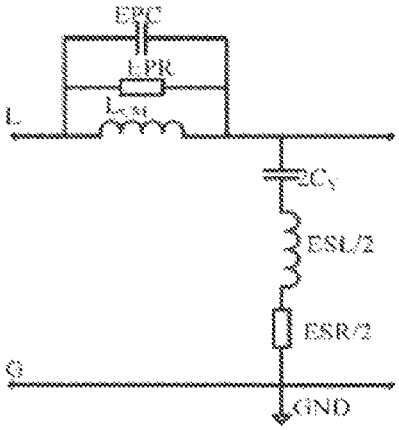
Figure 2 (Prior Art)
FIG. 2 is a schematic diagram of a practical LC equivalent filtering circuit.
Figure 3:
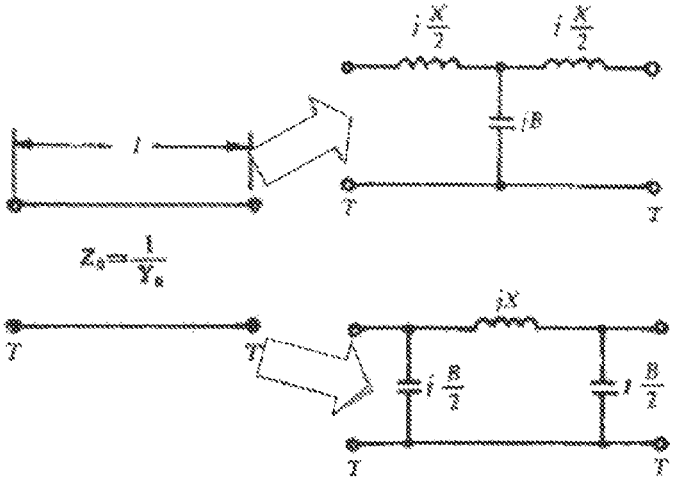
Figure 3 (Prior Art)
FIG. 3 shows an equivalent circuit of a conductor in a microwave domain.
Figure 4:
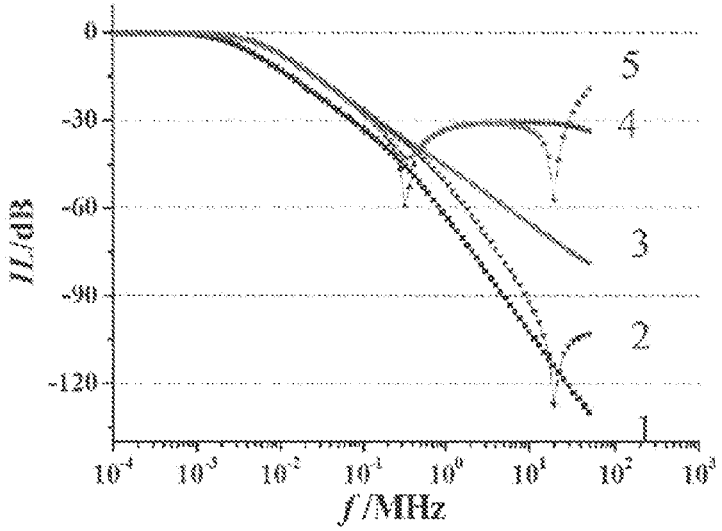
Figure 4 (Prior Art)
FIG. 4 shows different insertion losses of an LC circuit with different parasitic parameters being considered.
Figure 5:
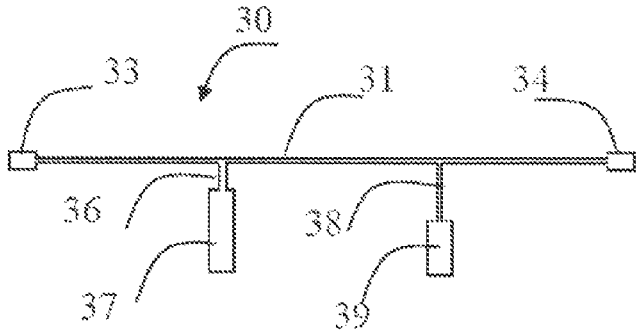
FIG. 5 is a schematic diagram of a microwave filter according to a first embodiment of the disclosure.

FIG. 5 illustrates a microwave filter 30 according to a first embodiment of the present invention, having a strip transmission line 31 and a filtering assembly connected to the transmission line 31. Two terminals 33, 34 of the transmission line 31 are configured as an input terminal and an output terminal respectively. The filtering assembly includes a strip first primary branch 36 connected directly to a first connection point of the transmission line 31 and a strip second primary branch 38 connected directly to a second connection point of the transmission line 31. The filtering assembly further includes a strip first secondary branch 37 connected directly to the first primary branch 36 and a second secondary branch 39 connected directly to the second primary branch 38. According to the first embodiment, the transmission line 31 and the second primary branch have a width of 0.2 mm, the first primary branch 36 has a width of 0.5 mm, and the first secondary branch 37 and the second secondary branch 39 have a width of 1.0 mm.

According to the first embodiment, all of the first primary branch 36, the first secondary branch 37, the second primary branch 38 and the second secondary branch 39 extend in a direction perpendicular to the transmission line 31. The first primary branch 36 and the second primary branch 38 are arranged on the same side of the transmission line 31.

Figure 6:
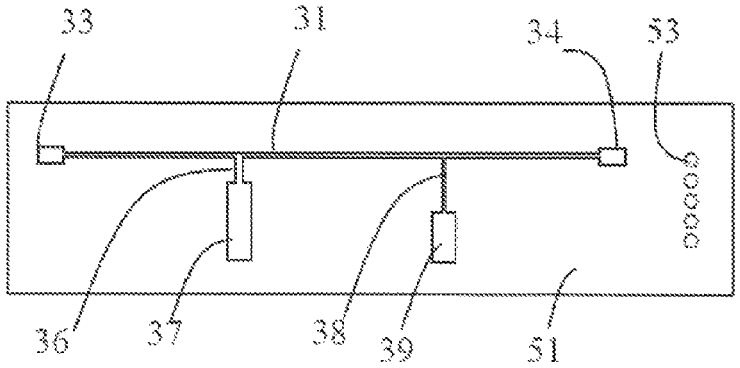
FIG. 6 is a schematic diagram of the microwave filter shown in FIG. 5 integrated into a printed circuit board.

Referring to FIG. 6, the microwave filter may be integrated into a printed circuit board or a flexible circuit board 51. A via hole 53 may be pre-formed in the circuit board 51 for passing through a related wire or pin.

Figure 7:
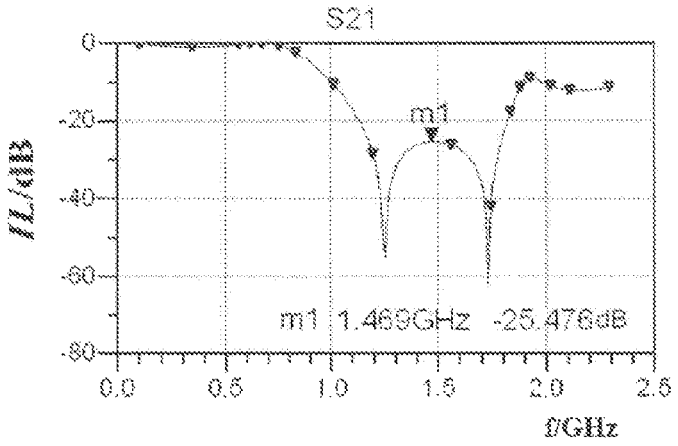
FIG. 7 is a diagram of a simulation result of the microwave filter shown in FIG. 5.

FIG. 7 is a graph of simulation results for the microwave filter of FIG. 5. The horizontal axis represents frequency and the vertical axis represents bandwidths. The curve in FIG. 7 shows that the microwave filter of FIG. 5 effectively attenuates signals in the frequency band between 1.0 MHz and 2.0 MHz (the curve in FIG. 7 is in compliance with the international standard CISPR25(2008)PK). The frequency band of the filter can be adjusted or tuned, primarily because the impedance of the transmission line 31 is changed due to the branches 36, 37, 38, 39, since the impedance of the transmission line is typically varied depending on different element dielectric constants.

Figure 8:
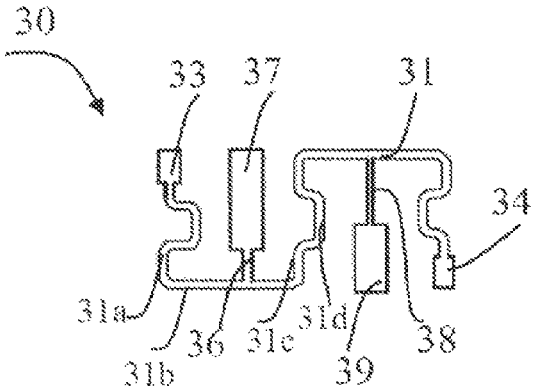
FIG. 8 is a schematic diagram of a microwave filter according to a second embodiment of the disclosure.

Referring to FIG. 8, a microwave filter according to a second embodiment of the present invention is a variant of the microwave filter shown in FIG. 5. One of the variations is that the first primary branch 36 and the second primary branch 38 are connected on opposite sides of the transmission line 31. Moreover, the transmission line 31 is bent in the direction of the first primary branch 36 on both sides of the first connection point to form a first "⊏"-shaped portion (see the "⊏"-shaped portion formed by sections 31*a*, 31*b* and 31*c* of the transmission line in FIG. 8). The transmission line 31 is bent in the direction of the second primary branch 38 on both sides of the second connection point to form a second "⊏"-shaped portion, and the opening of the first "⊏"-shaped portion is oriented in the opposite direction to the opening of the second "⊏"-shaped portion. The space occupied by the microwave filter is significantly reduced with this arrangement.

Furthermore, the transmission line 31 further includes a third "⊏"-shaped portion for connecting the first "⊏"-shaped portion and the second "⊏"-shaped portion in series. A similar "⊏"-shaped portion may also be arranged between the first connection point and the terminal 33, and the similar "⊏"-shaped portion may also be arranged between the second connection point and the terminal 34. The above first "⊏"-shaped portion, second "⊏"-shaped portion and third "⊏"-shaped portion may be used to improve the filtering effect of the microwave filter.

Figure 9:
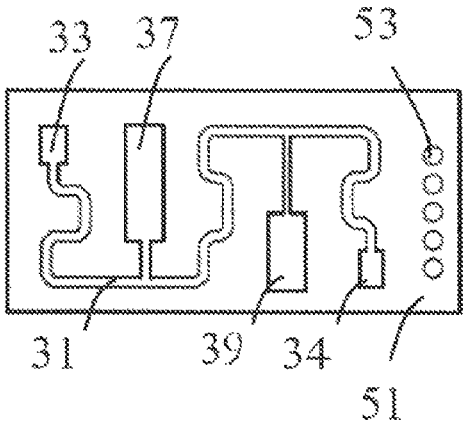
FIG. 9 is a schematic diagram of the microwave filter shown in FIG. 8 integrated into a printed circuit board.

Similarly, as shown in FIG. 9, the microwave filter shown in FIG. 8 may be integrated into a printed circuit board or a flexible circuit board 51. A via hole 53 may be pre-formed in the circuit board 51 for passing through a related wire or pin.

Figure 10:
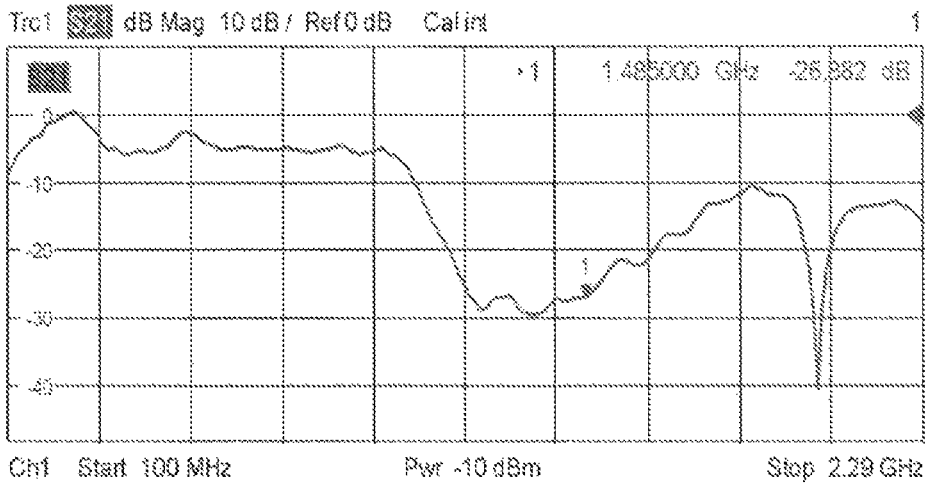
FIG. 10 is a diagram of a simulation result of the microwave filter shown in FIG. 8.

FIG. 10 is similar to FIG. 7, providing a graph of simulated results of the filter of FIG. 8. The horizontal axis represents frequency and the vertical axis represents bandwidths. The curve in FIG. 10 shows that the microwave filter of FIG. 8 may attenuate signals in a high frequency band.

Figure 11:
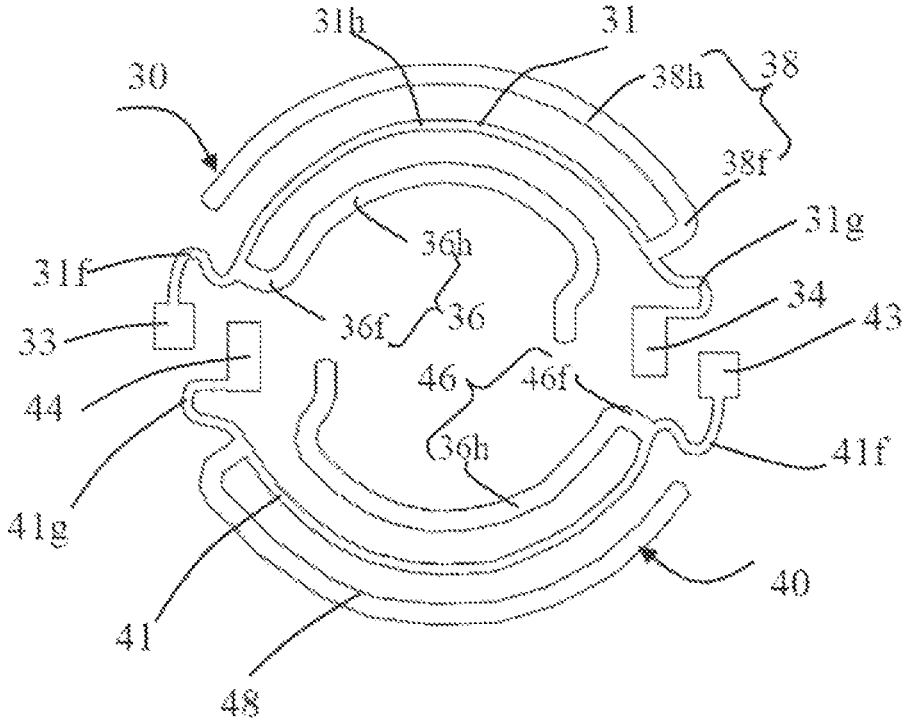
FIG. 11 is a schematic diagram of a microwave filter according to a third embodiment of the disclosure.

Referring to FIG. 11, according to a third embodiment of the disclosure, an independent microwave filter 30 and an independent microwave filter 40 are arranged facing each other to form a ring shape. Preferably, the microwave filter 30 and the microwave filter 40 are symmetrical about a center of the ring. The microwave filter 30 includes a strip transmission line 31, two terminals 33, 34 of which are configured as an input terminal and an output terminal respectively. The filter assembly includes a strip first primary branch 36 connected directly to a first connection point of the transmission line 31, the first primary branch 36 includes a first body portion 36*h* and a first bent portion 36*f* at a first end of the first body portion 36*h*, where the first bent portion 36*f* is connected directly to the first connection point, and the first body portion 36*h* is substantially parallel to a body portion 31*h* of the transmission line 31, that is, the first body portion 36*h* and the body portion 31*h* of the transmission line 31 are approximately evenly spaced or extend in the same direction.

The filtering assembly further includes a strip second primary branch 38 connected directly to a second connection point of the transmission line 31, the second primary branch 38 includes a second body portion 38*h* and a second bent portion 38*f* at a first end of the second body portion 38*h*, where the second bent portion 38*f* is connected directly to the second connection point, and the second body portion 38*h* is substantially parallel to a body portion 31*h* of the transmission line 31.

According to the present embodiment, the body portion 31*h* of the transmission line 31 is arc-shaped. The body portion 31*h* of the transmission line 31 is arranged between the first body portion 36*h* and the second body portion 38*h*. A width of the body portion 31*h* of the transmission line, a width of the first body portion 36*h* and a width of the second body portion 38*h* are different. Specifically, the body portion 31*h* has a width of 0.5 mm, and the first body portion 36*h* and the second body portion 38*h* have a width of 1.0 mm.

Preferably, the transmission line 31 further includes a bent portion 31*f* formed between the first connection point and the terminal 33 and a bent portion 31*g* formed between the second connection point and the terminal 34. The bent portion 31*f* and the bent portion 31*g* are used to improve the filtering effect of the microwave filter.

The microwave filter 40 has a structure symmetrical to the structure of the microwave filter 30, and thus the specific description is omitted.

Figure 12:
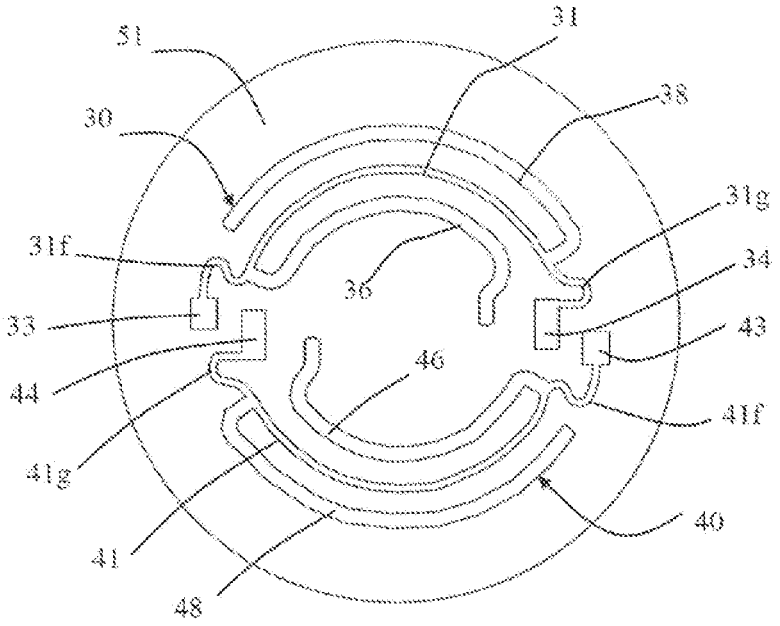
FIG. 12 is a schematic diagram of the microwave filter shown in FIG. 11 integrated into a printed circuit board.

As shown in FIG. 12, the microwave filter shown in FIG. 11 may be integrated into a printed circuit board or a flexible circuit board 51.

Figure 13:
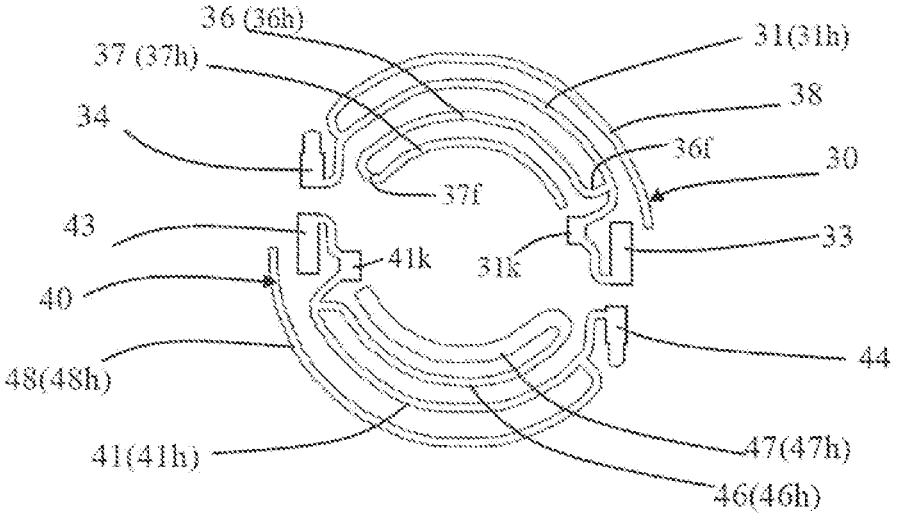
FIG. 13 is a schematic diagram of a microwave filter according to a fourth embodiment of the disclosure.
Figure 14:
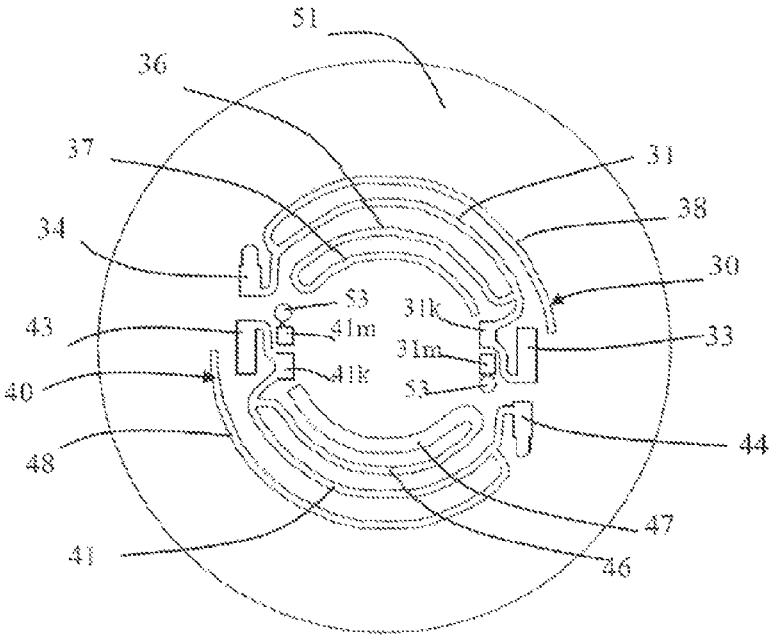
FIG. 14 is a schematic diagram of the microwave filter shown in FIG. 13 integrated into a printed circuit board.

Referring to FIG. 13, a microwave filter according to a fourth embodiment of the disclosure is a variant of the microwave filter shown in FIG. 11. One of the variations is that the filtering assembly further includes a first secondary branch 37, the first secondary branch 37 includes a third body portion 37*h* and a third bent portion 37*f* at a first end of the third body portion 37*h*, where the third bent portion 37*f* is connected directly to a second end of the first body portion 36*h*, and the third body portion 37*h* is substantially parallel to the first body portion 36*h*. Another variation, as shown in FIG. 14, is that a bent portion is formed between the first connection point and the terminal 33 of the transmission line 31, a first pad 31*k* is arranged at the bent portion, a second pad 31*m* is arranged adjacent to the first pad 31*k*, and a capacitor may be connected to the first pad 31*k* and the second pad 31*m* by welding or soldering. The second pad 31*m* is connected to a circuit on the back side of the circuit board through a via hole 53.

According to the present embodiment, all of the body portion 31*h* of the microwave filter 30, the first body portion 36*h*, the second body portion 38*h* and the third body portion 37*h* have a width of 0.5 mm.

According to the present embodiment, all of the body portion 41*h* of the transmission line 41, the first body portion 46*h* of the first primary branch 46, the second body portion 48*h* of the second primary branch 48 of the microwave filter 40 have a width of 0.5 mm, and the third body portion 47 of the first secondary branch 47 have a width of 1.0 mm.

It should be noted that, in the above embodiments, the widths of the transmission lines 31 and 41, the first primary branches 36 and 46, the second primary branches 38 and 48 and the first secondary branches 37 and 47 may be varied as required, for example, may be increased or decreased by a range from 0.05 mm to 0.1 mm. A bent portion is formed between the first connection point and the terminal 33 of the transmission line 41, a first pad 41*k* is arranged at the bent portion, a second pad 41*m* is arranged adjacent to the first pad 41*k*, and a capacitor may be connected to the first pad 41*k* and the second pad 41*m* by welding or soldering. The second pad 41*m* is connected to a circuit on the back side of the circuit board through the via hole 53.

Figure 15:
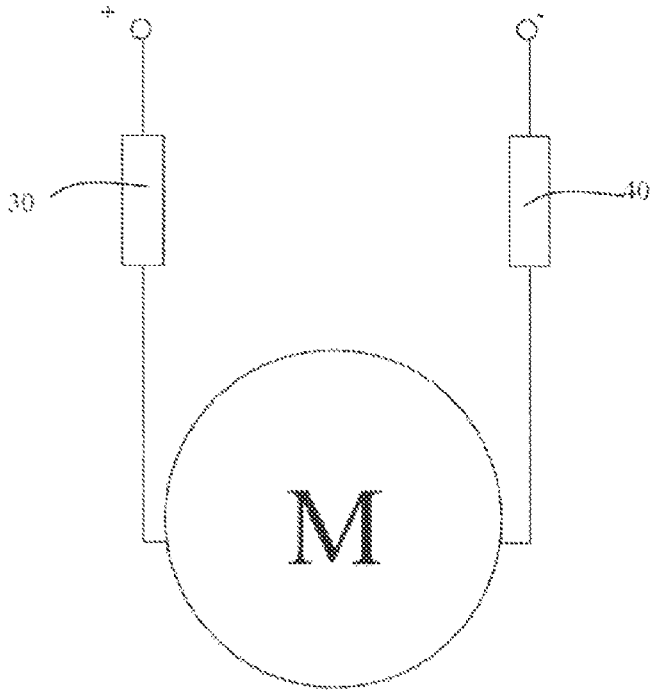
FIG. 15 is a schematic diagram of a motor incorporating the microwave filter according to the disclosure.

Referring to FIG. 15, a motor M according to an embodiment of the disclosure includes the microwave filters 30 and 40 according to the disclosure which are connected in series with the power supply circuit of the motor. Preferably, the motor is a brushed motor, and the microwave filters 30 and 40 are connected between terminals of the motor and the brushes, respectively. For example, the terminal 33 of the microwave filter 30 is connected between one of the terminals of the motor and one of the brushes, the terminal 43 of the microwave filter 40 is connected between the other terminal of the motor and the other brush. The terminals of the motor are connected to an external power supply, and the brushes are in sliding contact with a commutator to supply power to motor windings wound on the rotor. The applied microwave filter may be fitted within a housing of the motor, for example at the inner side of an end cap, or may be arranged at the outer side of the end cap. Preferably, the two microwave filters may be arranged in the same plane; more preferably, the two microwave filters may be printed on a common circuit board with the two microwave filters being arranged into a ring shape, as shown in FIGS. 11 to 14. The circuit board may be mounted outside of the end cap of the motor housing or inside the motor. It should be noted that the microwave filters shown in FIG. 5 and FIG. 8 may be also applied to the motor M.

In the description and claims of the present application, each of the verbs "comprise", "include", "contain" and "have", and variations thereof, are used in an inclusive sense, to specify the presence of the stated item or feature but do not preclude the presence of additional items or features.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of example only, and various other modifications will be apparent to persons skilled in the field without departing from the scope of the invention as defined by the appended claims.

The invention claimed is:

1. A microwave filter, comprising: a strip transmission line having an input terminal and an output terminal, and a filtering assembly connected to the transmission line, wherein the filtering assembly comprises a strip first primary branch connected directly to a first connection point of the transmission line and a strip first secondary branch connected directly to the first primary branch, and wherein a width of the first secondary branch is different from a width of the first primary branch, the filtering assembly further comprises a strip second primary branch connected directly to a second connection point of the transmission line, and a second secondary branch connected directly to the second primary branch, wherein a width of the second secondary branch is different from a width of the second primary branch.

2. The microwave filter of claim 1, wherein the first primary branch extends in a direction perpendicular to the transmission line.

3. The microwave filter of claim 1, wherein a width of the second primary branch is different from a width of the first primary branch.

4. The microwave filter of claim 1, wherein the first primary branch and the second primary branch are arranged at two opposite sides of the transmission line respectively.

5. The microwave filter of claim 4, wherein the transmission line is bent in a direction of the first primary branch on both sides of the first connection point to form a first "⊏"-shaped portion; and the transmission line is bent in a direction of the second primary branch on both sides of the second connection point to form a second "⊏"-shaped portion, wherein an opening of the first "⊏"-shaped portion is oriented in an opposite direction to an opening of the second "⊏"-shaped portion.

6. The microwave filter of claim 5, wherein the transmission line further comprises a third "⊏"-shaped portion for connecting the first "⊏"-shaped portion to the second "⊏"-shaped portion in series.

7. An electric motor, comprising a power supply circuit for the motor, wherein the microwave filter of claim 1 is connected in series with the power supply circuit.

8. A microwave filter, comprising: a strip transmission line having an input terminal and an output terminal, and a filtering assembly connected to the transmission line, wherein the filtering assembly comprises a strip first primary branch connected directly to a first connection point of the transmission line, wherein the first primary branch comprises a first body portion and a first bent portion at a first end of the first body portion, wherein the first bent portion is connected directly to the first connection point, and the first body portion is substantially parallel to a body portion of the transmission line, and wherein a width of the transmission line and a width of the first primary branch are in a range between 0.15 mm and 1.1 mm.

9. The microwave filter of claim 8, wherein the filtering assembly further comprises a strip second primary branch connected directly to a second connection point of the transmission line, the second primary branch comprises a second body portion and a second bent portion at a first end of the second body portion, wherein the second bent portion is connected directly to the second connection point, and the second body portion is substantially parallel to the body portion of the transmission line.

10. The microwave filter of claim 9, wherein the body portion of the transmission line is arranged between the first body portion and the second body portion.

11. The microwave filter of claim 9, wherein the body portion of the transmission line is arc-shaped.

12. The microwave filter of claim 9, wherein a width of the body portion of the transmission line, a width of the first body portion and a width of the second body portion are different.

13. The microwave filter of claim 8, wherein a pad is formed between a terminal and the first connection point of the transmission line.

14. An electric motor, comprising a power supply circuit for the motor, wherein at least one microwave filter according to claim 8 is connected in series in the power supply circuit.

15. A microwave filter, comprising: a strip transmission line having an input terminal and an output terminal, and a filtering assembly connected to the transmission line, wherein the filtering assembly comprises a strip first primary branch connected directly to a first connection point of the transmission line, wherein the first primary branch comprises a first body portion and a first bent portion at a first end of the first body portion, wherein the first bent portion is connected directly to the first connection point, and the first body portion is substantially parallel to a body portion of the transmission line, wherein the filtering assembly further comprises a first secondary branch, the first secondary branch comprises a third body portion and a third bent portion at a first end of the third body portion, wherein the third bent portion is connected directly to a second end of the first body portion, and the third body portion is substantially parallel to the first body portion.

16. An electric motor, comprising a power supply circuit for the motor and two microwave filters connected in series in the power supply circuit, each microwave filter comprising a strip transmission line having an input terminal and an output terminal, and a filtering assembly connected to the transmission line, wherein the filtering assembly comprises a strip first primary branch connected directly to a first connection point of the transmission line, wherein the first primary branch comprises a first body portion and a first bent portion at a first end of the first body portion, wherein the first bent portion is connected directly to the first connection point, and the first body portion is substantially parallel to a body portion of the transmission line, and wherein the two microwave filters are arranged in a same plane in the motor.

17. An electric motor, comprising a power supply circuit for the motor and two microwave filters connected in series in the power supply circuit, each microwave filter comprising a strip transmission line having an input terminal and an output terminal, and a filtering assembly connected to the transmission line, wherein the filtering assembly comprises a strip first primary branch connected directly to a first connection point of the transmission line, wherein the first primary branch comprises a first body portion and a first bent portion at a first end of the first body portion, wherein the first bent portion is connected directly to the first connection point, and the first body portion is substantially parallel to a body portion of the transmission line, and wherein the two microwave filters are arranged in a ring shape in the motor.

* * * * *